US008702577B2

(12) United States Patent
Krischer

(10) Patent No.: US 8,702,577 B2
(45) Date of Patent: Apr. 22, 2014

(54) LIQUID SAMPLE COLLECTION DEVICE FOR ZONAL CENTRIFUGATION

(75) Inventor: Horst G. Krischer, Westfield, IN (US)

(73) Assignee: Beckman Coulter, Inc., Brea, CA (US)

( * ) Notice: Subject to any disclaimer, the term of this patent is extended or adjusted under 35 U.S.C. 154(b) by 922 days.

(21) Appl. No.: 12/867,264

(22) PCT Filed: Feb. 11, 2009

(86) PCT No.: PCT/US2009/033725

§ 371 (c)(1),
(2), (4) Date: Aug. 12, 2010

(87) PCT Pub. No.: WO2009/102473

PCT Pub. Date: Aug. 20, 2009

(65) Prior Publication Data

US 2010/0311560 A1 Dec. 9, 2010

Related U.S. Application Data

(60) Provisional application No. 61/028,301, filed on Feb. 13, 2008.

(51) Int. Cl.
*B04B 7/06* (2006.01)
*B04B 7/02* (2006.01)

(52) U.S. Cl.
USPC ..... 494/12; 494/37; 494/60

(58) Field of Classification Search
USPC ..... 494/16–21, 12, 31–34, 13–14, 43, 60, 494/61, 85, 37; 210/360.1
See application file for complete search history.

(56) References Cited

U.S. PATENT DOCUMENTS

| | | | | | |
|---|---|---|---|---|---|
| 3,339,836 | A * | 9/1967 | Mitchell et al. | 494/16 |
| 3,765,601 | A * | 10/1973 | Gulley | 494/38 |
| 3,804,324 | A * | 4/1974 | Sinn et al. | 494/14 |
| 3,907,022 | A | 9/1975 | Simons et al. | |
| 4,193,536 | A * | 3/1980 | Kubota | 494/14 |
| 4,196,844 | A * | 4/1980 | Jacobson | 494/12 |
| 4,221,325 | A * | 9/1980 | Kubota | 494/14 |
| 4,484,906 | A | 11/1984 | Strain | |
| 4,764,162 | A * | 8/1988 | Romanauskas | 494/38 |
| 5,538,492 | A * | 7/1996 | Potter | 494/12 |
| 5,855,545 | A * | 1/1999 | Kishi et al. | 494/12 |
| 6,063,017 | A * | 5/2000 | Romanauskas et al. | 494/12 |
| 7,331,918 | B2 * | 2/2008 | Hayasaka et al. | 494/12 |
| 7,367,932 | B2 * | 5/2008 | Niinai | 494/12 |
| 2005/0233884 | A1 * | 10/2005 | Hayasaka et al. | 494/60 |
| 2005/0272587 | A1 * | 12/2005 | Niinai | 494/12 |
| 2006/0219620 | A1 | 10/2006 | Suga | |
| 2010/0311560 | A1 * | 12/2010 | Krischer | 494/37 |
| 2013/0178352 | A1 * | 7/2013 | Goellnitz et al. | 494/60 |

FOREIGN PATENT DOCUMENTS

JP 2008-238100 * 10/2008

* cited by examiner

*Primary Examiner* — Charles E Cooley
(74) *Attorney, Agent, or Firm* — Merchant & Gould P.C.

(57) ABSTRACT

A centrifuge comprising a zonal rotor, a centrifuge chamber having a side wall and a bottom wall to contain the zonal rotor, an upper shield to cover the top of the centrifuge chamber and enclose the zonal rotor, and an annulus in the centrifuge chamber that is laterally spaced apart from the zonal rotor. The annulus has a channel with a base and a lip, where the channel has an open end facing the direction of the upper shield to collect liquid sample leaked during loading or unloading the zonal rotor.

14 Claims, 11 Drawing Sheets

LIQUID SAMPLE COLLECTION DEVICE FOR ZONAL CENTRIFUGATION

RELATED APPLICATION

This application claims benefit of priority under 35 U.S.C. 119(e) to U.S. Provisional Patent Application No. 61/028,301 filed on Feb. 13, 2008, which is incorporated herein by reference in its entirety.

BACKGROUND OF THE INVENTION

The present invention pertains generally to a liquid sample collection device for use in the process of zonal centrifugation. The device captures liquid sample that may spill or leak during the process of loading or unloading liquid sample while the rotor is spinning. This prevents the leaked liquid sample from coming into contact with sensitive components inside the centrifuge chamber, thereby protecting the centrifuge from damage.

In the process of zonal centrifugation, the centrifuge rotor is loaded and unloaded with liquid sample while the rotor is spinning. During the loading and unloading of liquid sample, it is difficult to maintain a complete, tight seal between the spinning rotor and the stationary sample-loading apparatus. Consequently, some of the liquid sample may leak into the centrifuge chamber during the loading or unloading of the zonal rotor. The centrifugal force of the spinning rotor tends to propel this leaked liquid outward towards the wall of the centrifuge chamber. This leaked liquid may then flow down the wall of the centrifuge and settle on the bottom of the centrifuge chamber where it may come into contact with sensitive electronic or mechanical components of the centrifuge causing damage to the centrifuge.

It is therefore desirable to prevent damage to a centrifuge caused by exposure to liquid sample that leaks into the centrifuge chamber during the loading and unloading of a rotor during zonal centrifugation. The present invention provides a liquid sample collection device that captures this leaked liquid, thereby preventing damage to the centrifuge.

BRIEF SUMMARY OF THE INVENTION

The present invention provides a liquid sample collection device that captures leaked liquid sample during the process of loading or unloading of a zonal rotor. The top of the device supports the liquid sample fill head of the zonal rotor. The top and side interior walls of the device provide containment for leaked liquid sample that is propelled outward due to centrifugal force of the spinning rotor. A lip at the bottom of the device forms a channel to collect the liquid sample that flows down the walls of the device. The sample collection device is removed from the centrifuge after loading or unloading of the zonal rotor, thereby removing the leaked liquid sample from the chamber and preventing the leaked liquid sample from coming into contact with sensitive components inside the centrifuge chamber.

DETAILED DESCRIPTION OF THE INVENTION

The present invention provides a device for capturing liquid sample that leaks during the loading or unloading of a zonal rotor. The device prevents leaked liquid sample from collecting on the walls of the centrifuge chamber and from coming into contact with sensitive electrical or mechanical components inside the centrifuge. An advantage is the prevention of damage to the centrifuge that may arise due to contact of the leaked liquid sample with sensitive components inside the centrifuge. Another advantage is the prevention of liquid accumulation on the walls of the centrifuge chamber that may interfere with obtaining the proper vacuum inside the chamber during centrifugation.

DEFINITIONS

A liquid sample fill head is a fixture including ball bearing and rotating/stationary seal that is used to load and unload sample into/out-of a spinning zonal rotor.

A zonal rotor is a centrifuge rotor that can be loaded and unloaded with sample while spinning for the process of zonal centrifugation.

Loading of a zonal rotor means adding sample to a zonal rotor while the rotor is spinning at a rotor loading speed.

Unloading of a zonal rotor means removing sample from a zonal rotor while the rotor is spinning at a rotor unloading speed.

Figure 1:
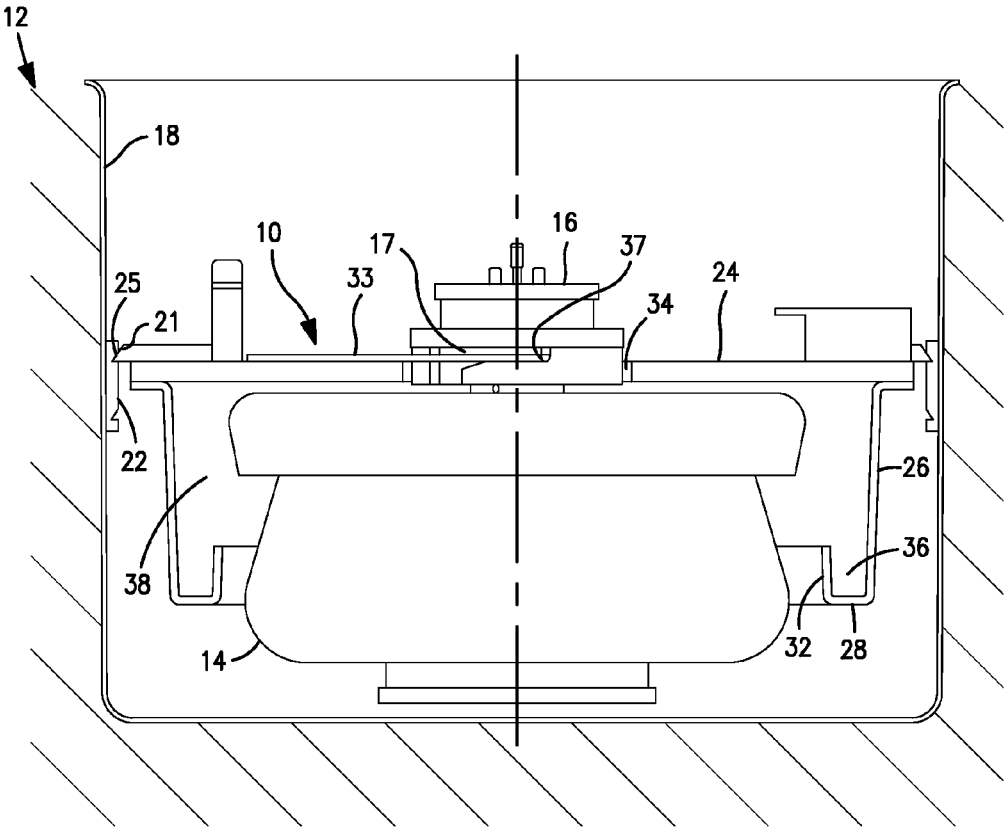
FIG. 1 illustrates a liquid sample collection device in accordance with the present invention arranged in a centrifuge.
Figure 2:
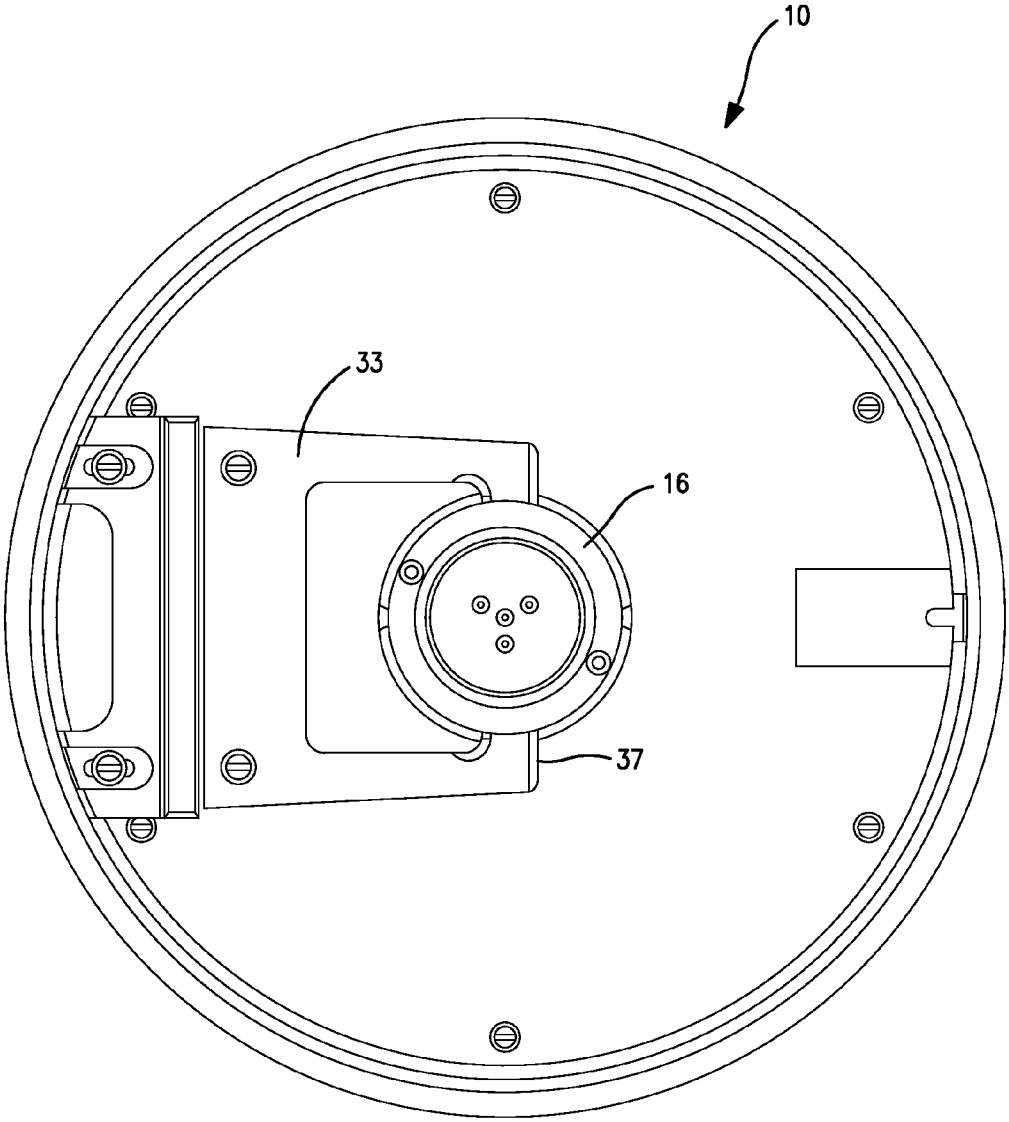
FIG. 2 illustrates a top view of a liquid sample collection device in accordance with the present invention.
Figure 3:
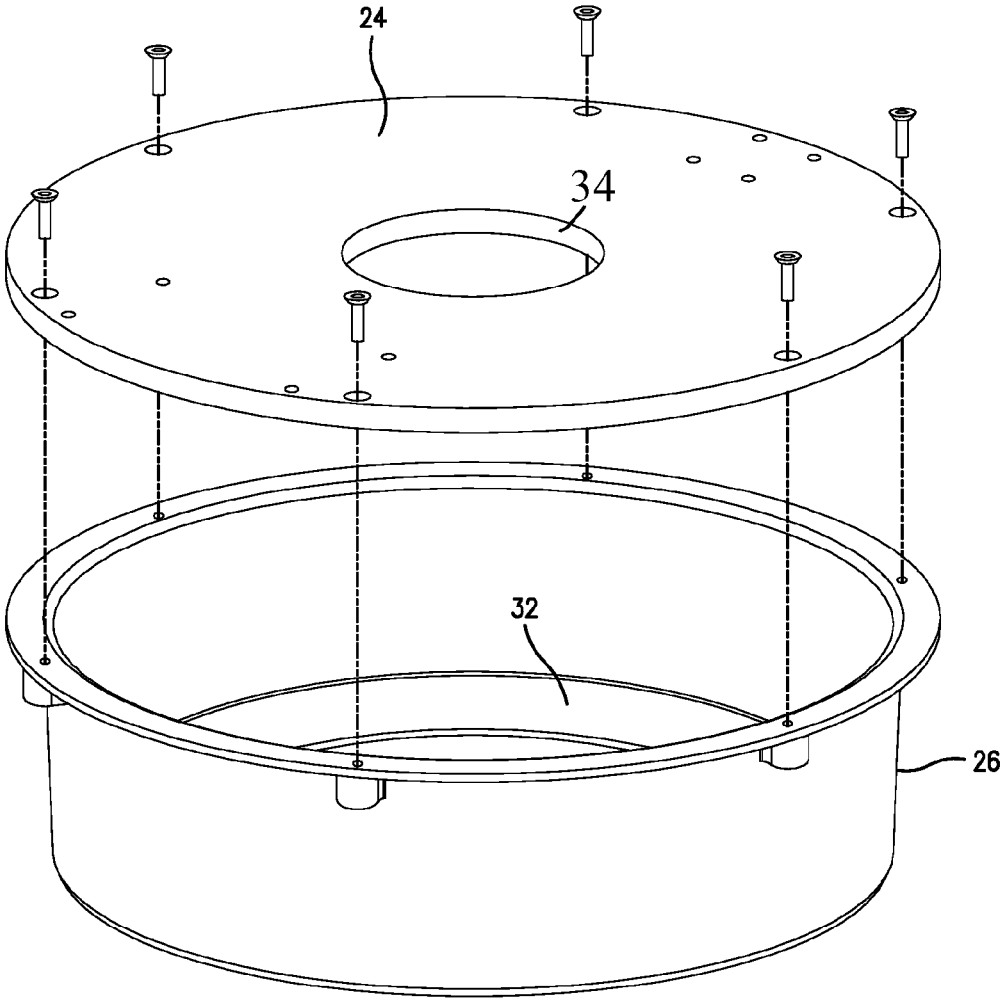
FIG. 3 illustrates an isometric view of an upper shield and an annulus in accordance with the present invention.
Figure 4:
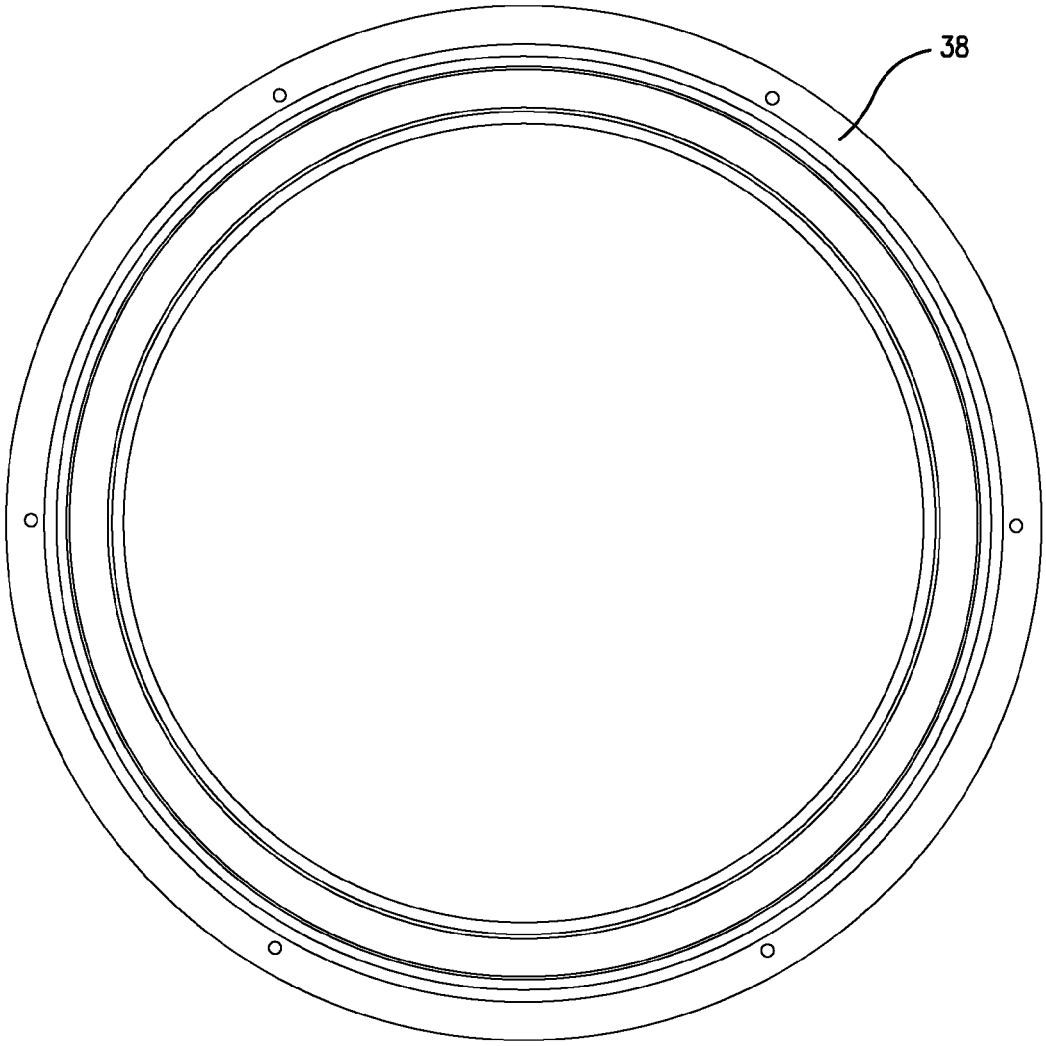
FIG. 4 illustrates a top view of an annulus in accordance with the present invention.
Figure 5:
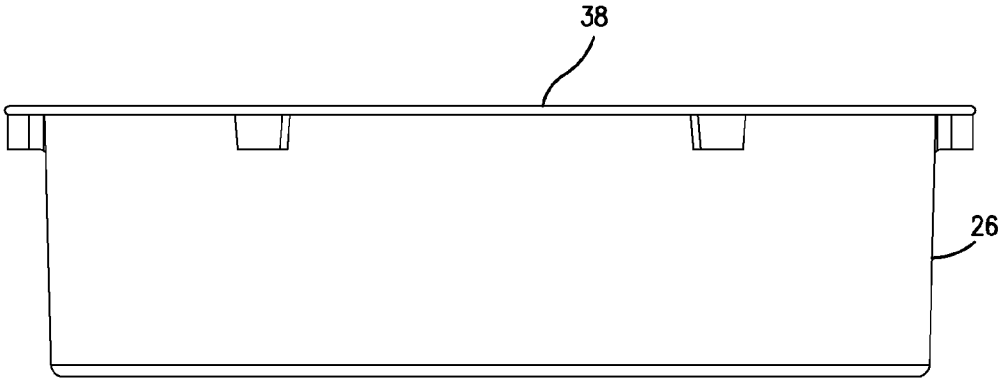
FIG. 5 illustrates a front view of an annulus in accordance with the present invention.
Figure 6:
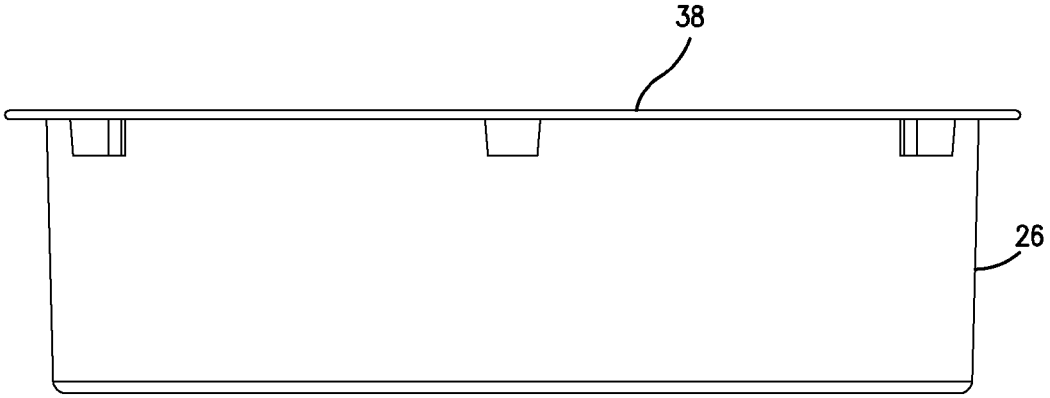
FIG. 6 illustrates a right side view of an annulus in accordance with the present invention.
Figure 7:
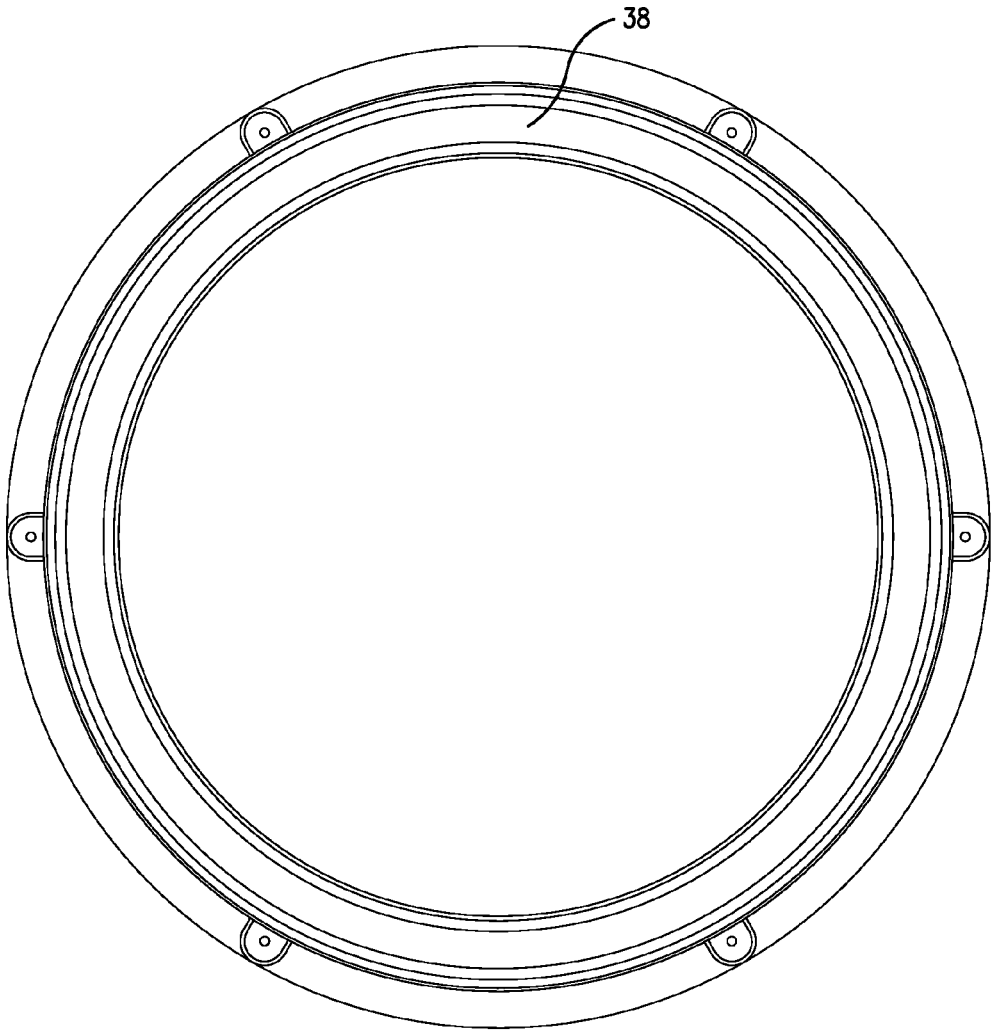
FIG. 7 illustrates a bottom view of an annulus in accordance with the present invention.
Figure 8:
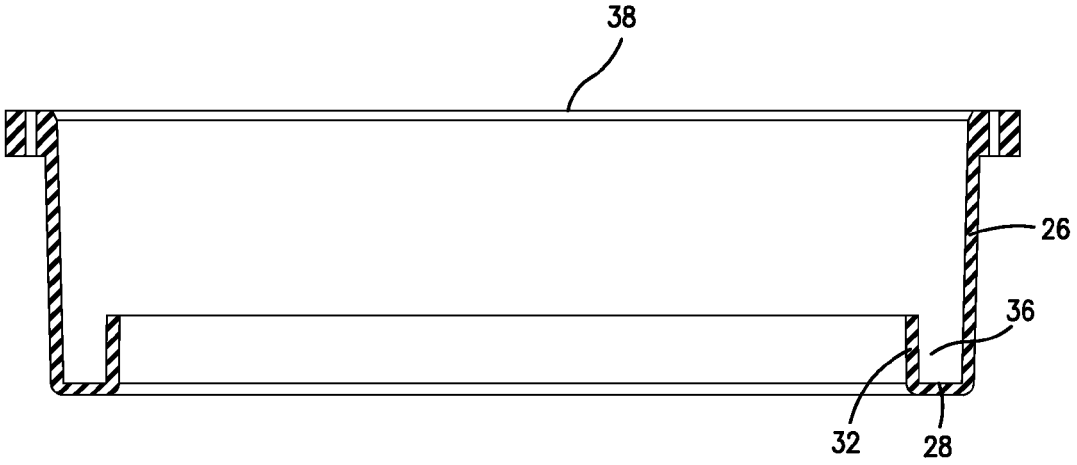
FIG. 8 illustrates a section view of an annulus in accordance with the present invention.
Figure 9:
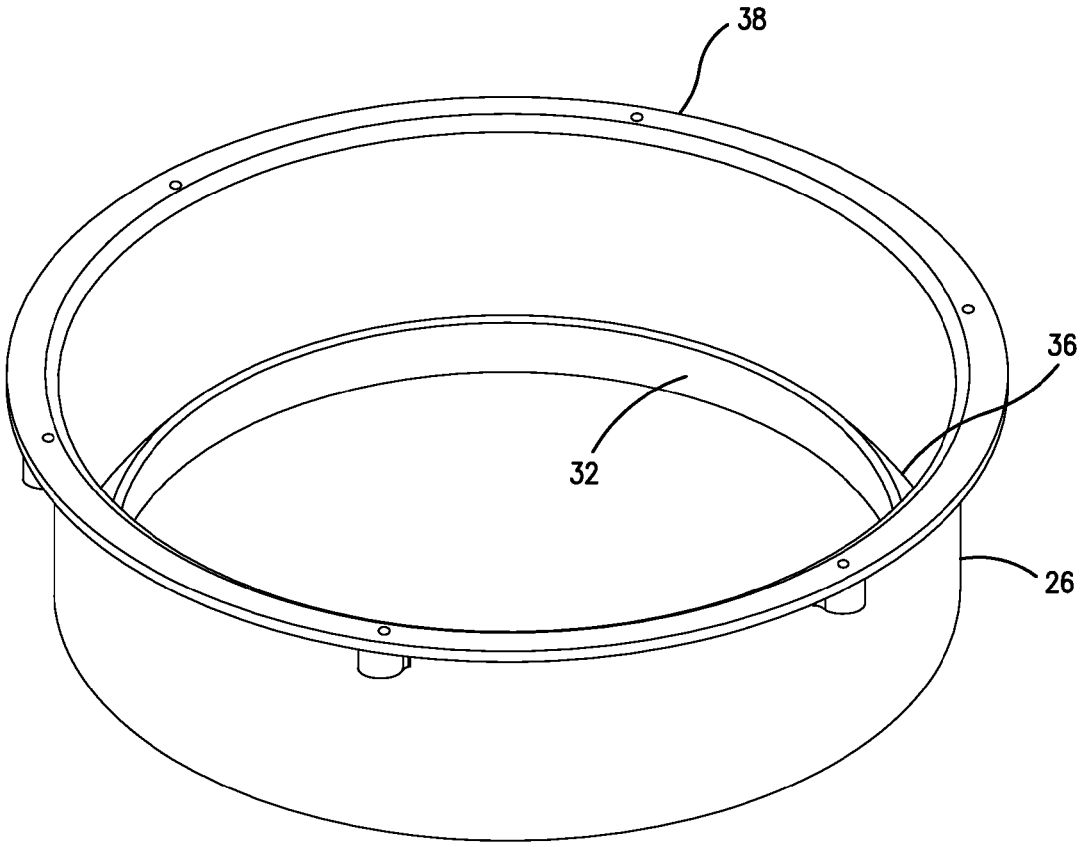
FIG. 9 illustrates an isometric view of an annulus in accordance with the present invention.

FIG. 1 illustrates a liquid sample collection device 10, an embodiment of the present invention, arranged in a centrifuge 12. The arrangement includes the liquid sample collection device 10 disposed about a zonal rotor 14 and a liquid sample fill head 16 inside a centrifuge chamber 18. A support band 22, which may be a metal ring, is located on the inside of the centrifuge chamber 18 to position the liquid sample collection device 10 at the correct location relative to the zonal rotor 14. In the illustrated embodiment, tabs 21 project outward from generally the top outer edge of the liquid sample collection device 10, and corresponding slots 25 are located on the support band 22. The tabs 21 fit into the slots 25 to position and hold the liquid sample collection device 10 at the correct location relative to the zonal rotor 14. The tabs 21 may be retractable to facilitate the insertion of the tabs 21 into the slots 25. Although the embodiment depicted in FIG. 1 discloses a metal support band 22 with slots 25, the support band 22 can be any suitable structure for holding and positioning the liquid sample collection device 10. The liquid sample fill head 16 may be installed onto the liquid sample collection device 10 for the loading and unloading of the zonal rotor 14 with liquid sample while the zonal rotor 14 is spinning.

In a preferred embodiment, the liquid sample collection device 10 includes an upper shield 24, a vertical wall 26, a base 28, and a lip 32. In the illustrated embodiment, the upper shield 24 is a circular plate with a central hole 34. The central hole 34 facilitates the liquid sample fill head 16 to attach to the zonal rotor 14 or to hold the liquid sample fill head 16 during the loading and unloading process. A bracket 33 with opposed fingers 37 is attached to the top of the upper shield 24 and is centered over the central hole 34. Locking grooves 17 are formed in opposite sides of the liquid sample fill head 16. The locking grooves 17 engage the opposed fingers 37 to install and reversibly lock the liquid sample fill head 16 into position on the upper shield 24 for loading and unloading the zonal rotor 14.

The vertical wall 26 is generally a cylinder that extends downward from about the outer radial edge of the upper shield 24. The base 28 depends toward the zonal rotor 14 and the lip 32 extends vertically from the base 28. Arranged this way, the vertical wall 26, base 28 and lip 32 form a channel 36 where liquid sample that leaks from the liquid sample fill head 16 during loading or unloading of the zonal rotor 14 is contained by the upper shield 24 and the vertical wall 26, and is collected in the channel 36. The upper shield 24 prevents leaked sample from being expelled upward out of the centrifuge, while the vertical wall 26 contains and captures leaked sample that is propelled outward by the centrifugal force of the spinning rotor 14. Contained liquid sample that flows down the vertical wall 26 collects in the channel 36. The containment of leaked liquid sample by the upper shield 24 and the vertical wall 26, and the collection of leaked liquid sample by the channel 36 prevents leaked liquid sample from accumulating inside the chamber 18 of the centrifuge 12. In the absence of such a containment and collection device, leaked liquid sample may come into contact with instrument electronics located underneath the refrigeration can, or with the centrifuge drive, resulting in component or drive failure.

In one embodiment, the upper shield 24, the vertical wall 26, the base 28 and the lip 32 are made from plastic. However, these parts may be made from any suitable material.

Also, in a preferred embodiment, the vertical wall 26, the base 28 and the lip 32 are molded as a one piece annulus 38.

In another embodiment, the vertical wall 26 is composed essentially of a stack of multiple cylindrical pieces.

After loading the zonal rotor 14 with sample, the liquid sample collection device 10 can be removed from the centrifuge 12 by disengaging the tabs 21 from the slots 25 and lifting the liquid sample collection device 10 off of the support band 22, thereby removing the collected leaked liquid sample from the centrifuge 12 before a vacuum is applied to the centrifuge chamber 18, the rotor is spun at a rotor centrifugation speed, and the centrifugation run is completed. An advantage is that the liquid sample collection device 10, being removable, does not interfere with temperature control during centrifugation. Likewise, the liquid sample collection device 10 can be removed after unloading the zonal rotor 14, thereby removing the collected leaked liquid sample from the centrifuge 12. The rotor centrifugation speed may be greater than the rotor loading speed.

Figure 10:
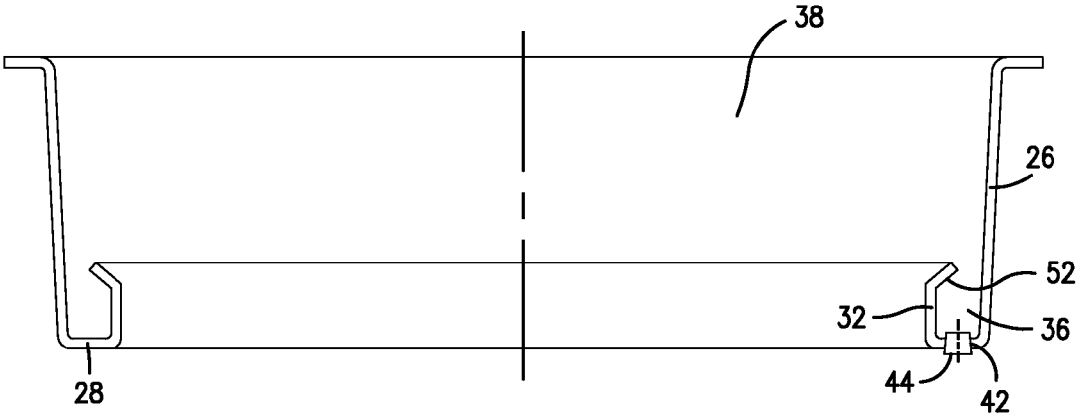
FIG. 10 illustrates a section view of an annulus in accordance with the present invention.

In a preferred embodiment, a drain hole 42 is formed in the base 28 (FIG. 10). A plug 44 reversibly seals the drain hole 42 to provide for the removal of collected fluid from the liquid sample collection device 10 after the liquid sample collection device 10 has been removed from the centrifuge 12.

Figure 11:
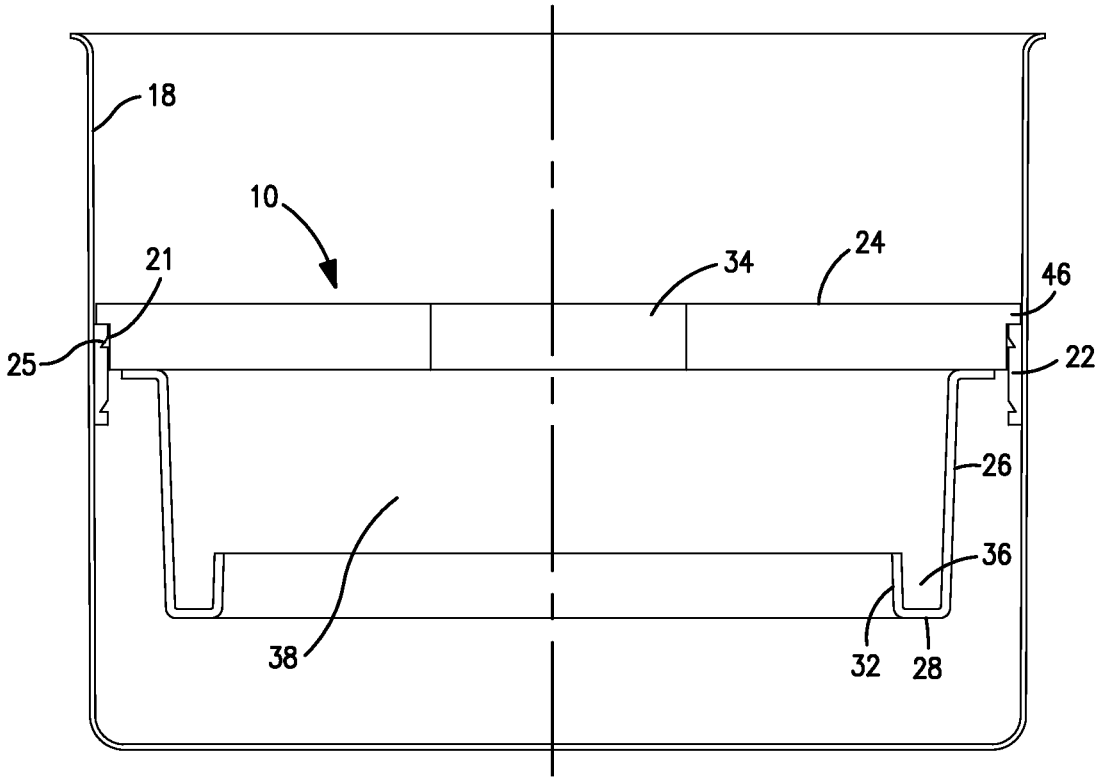
FIG. 11 illustrates a liquid sample collection device in accordance with the present invention arranged in a centrifuge.

In another preferred embodiment, a piloting feature 46 extends outward from the upper circumference of the upper shield 24 (FIG. 11). The piloting feature 46 facilitates the installation and the positioning of the liquid sample collection device 10 in the centrifuge chamber 18 by guiding the liquid sample collection device 10 in essentially straight upwards or straight downwards movement when the liquid sample collection device is installed into or removed from the centrifuge chamber 18, thereby avoiding contact of the liquid sample collection device 10 with the spinning zonal rotor 14.

In another preferred embodiment, the liquid sample collection device 10 includes a projection 52 extending generally outwards from the top of the lip 32 towards the vertical wall 26 (FIG. 10). The projection 52 serves to narrow the opening to the channel 36, thereby reducing the chance of spilling liquid sample out of the channel 36 when the liquid sample collection device 10 is removed from the centrifuge 12.

What is claimed is:

1. A centrifuge, comprising:

a zonal rotor;

a centrifuge chamber having a side wall and a bottom wall to contain the zonal rotor;

an upper shield sized to cover the top of the centrifuge chamber to enclose the zonal rotor; and an annulus disposed in the centrifuge chamber laterally spaced-apart from the zonal rotor, the annulus comprising a channel including a base and a lip, the channel having an open end facing the direction of the upper shield to collect liquid sample leaked during loading or unloading the zonal rotor, wherein the channel and the zonal rotor are concentric, and wherein the outer diameter of the zonal rotor is less than the inner diameter of the channel.

2. The centrifuge of claim 1 wherein the annulus further comprises a vertical wall extending from the upper shield to the base of the channel, wherein the annulus is removably positioned in the centrifuge chamber.

3. The centrifuge of claim 1 wherein the upper shield has a planar face disposed over the open end of the channel.

4. The centrifuge of claim 1 wherein the lip is disposed between the zonal rotor and the side wall of the centrifuge chamber.

5. The centrifuge of claim 1 further comprising a centrifuge drive configured to spin the zonal rotor about a vertical axis of rotation, wherein the largest horizontal distance between the axis of rotation and the outer surface of the rotor is less than the smallest distance between the axis of rotation and the lip of the channel.

6. The centrifuge of claim 1 wherein the base of the channel is disposed between the bottom wall of the centrifuge chamber and the upper shield.

7. The centrifuge of claim 1 wherein the annulus is configured to remain stationary while the zonal rotor is spinning.

8. The centrifuge of claim 1 further comprising a support band connected to the side wall of the centrifuge chamber, the support band configured to support the upper shield and annulus.

9. A method of collecting liquid sample leaked during loading a zonal rotor in a centrifuge, comprising the steps of:

positioning a liquid sample collection device in a centrifuge chamber, the liquid sample collection device including an upper shield and an annulus, the annulus having a channel comprising a base and a lip;

loading the liquid sample into the zonal rotor while the zonal rotor is spinning at a rotor loading speed;

collecting in the channel the leaked liquid sample while loading the zonal rotor;

removing from the centrifuge the leaked liquid sample collected in the channel; and centrifuging the liquid sample in the zonal rotor by spinning the zonal rotor at a rotor centrifugation speed, wherein the step of removing from the centrifuge the leaked liquid sample occurs before the step of centrifuging the liquid sample at the rotor centrifugation speed.

10. The method of claim 9, wherein the base of the channel is positioned above the bottom of the centrifuge chamber when the liquid sample collection device is positioned in the centrifuge chamber.

11. The method of claim 9, wherein the channel is positioned between the zonal rotor and a side wall of the centrifuge chamber when the liquid sample collection device is positioned in the centrifuge chamber.

12. The method of claim 9, wherein the channel does not overlap the circumference of the zonal rotor when the liquid sample collection device is positioned in the centrifuge chamber.

13. A centrifuge, comprising:

a zonal rotor;

a centrifuge chamber having a side wall and a bottom wall to contain the zonal rotor;

an upper shield sized to cover the top of the centrifuge chamber to enclose the zonal rotor; and an annulus disposed in the centrifuge chamber laterally spaced-apart from the zonal rotor, the annulus comprising a channel including a base and a lip, the channel having an open end facing the direction of the upper shield to collect liquid sample leaked during loading or unloading the zonal rotor, wherein the lip is disposed between the zonal rotor and the side wall of the centrifuge chamber.

14. A centrifuge, comprising:

a zonal rotor;

a centrifuge chamber having a side wall and a bottom wall to contain the zonal rotor;

an upper shield sized to cover the top of the centrifuge chamber to enclose the zonal rotor;

an annulus disposed in the centrifuge chamber laterally spaced-apart from the zonal rotor, the annulus comprising a channel including a base and a lip, the channel having an open end facing the direction of the upper shield to collect liquid sample leaked during loading or unloading the zonal rotor; and a centrifuge drive configured to spin the zonal rotor about a vertical axis of rotation, wherein the largest horizontal distance between the axis of rotation and the outer surface of the rotor is less than the smallest distance between the axis of rotation and the lip of the channel.

* * * * *